US005447643A

United States Patent [19]

Kelkenberg et al.

[11] Patent Number: 5,447,643

[45] Date of Patent: Sep. 5, 1995

[54] AQUEOUS FABRIC SOFTENER FOR THE TREATMENT OF TEXTILE

[75] Inventors: Heike Kelkenberg, Gladbeck; Michael Brock, Schermbeck, both of Germany

[73] Assignee: Huels Aktiengesellschaft, Marl, Germany

[21] Appl. No.: 178,402

[22] Filed: Jan. 6, 1994

[30] Foreign Application Priority Data

Jan. 20, 1993 [DE] Germany ..... 43 01 459.3

[51] Int. Cl.[6] ..... D06M 15/00

[52] U.S. Cl. ..... 252/8.6; 252/8.8

[58] Field of Search ..... 252/8.6, 8.8

[56] References Cited

U.S. PATENT DOCUMENTS

| | | | |
|---|---|---|---|
| 4,179,332 | 12/1979 | Rudkin et al. | 252/8.8 |
| 4,311,601 | 1/1982 | Racciato | 252/8.6 |
| 4,326,965 | 4/1982 | Lips et al. | 252/8.6 |
| 4,379,059 | 4/1983 | Hockey et al. | 252/8.6 |
| 4,795,032 | 1/1989 | Kandathil | 252/8.6 |
| 4,851,141 | 7/1989 | Demangeon et al. | 252/8.8 |
| 4,970,028 | 11/1990 | Kenyon et al. | 252/8.8 |
| 5,114,600 | 5/1992 | Biggin et al. | 252/8.6 |
| 5,185,088 | 2/1993 | Hartman et al. | 252/8.6 |
| 5,246,611 | 9/1993 | Trinh | 252/8.6 |
| 5,290,475 | 3/1993 | Wixon | 252/8.8 |

FOREIGN PATENT DOCUMENTS

| | | |
|---|---|---|
| 0017120 | 10/1980 | European Pat. Off. . |
| 0017149 | 10/1980 | European Pat. Off. . |
| 0056695 | 7/1982 | European Pat. Off. . |
| 0115252 | 8/1984 | European Pat. Off. . |
| 0159919 | 10/1985 | European Pat. Off. . |
| 0086104 | 5/1989 | European Pat. Off. . |
| 0337354 | 10/1989 | European Pat. Off. . |
| 0350959 | 3/1993 | European Pat. Off. . |

OTHER PUBLICATIONS

H. Berenbold, Frankfurt–Hochst; "Tenside Surf."; Dec. 27, 1990;; pp. 34–40.

*Primary Examiner*—Anthony Green

*Attorney, Agent, or Firm*—Oblon, Spivak, McClelland, Maier, & Neustadt

[57] ABSTRACT

The present invention provides an aqueous fabric softener for the treatment of textiles based on water-insoluble nonionic surfactants whose emulsions or dispersions have been stabilized by the addition of protective colloids containing cationic groups.

20 Claims, No Drawings

AQUEOUS FABRIC SOFTENER FOR THE TREATMENT OF TEXTILE

BACKGROUND OF THE INVENTION

1. Field of the Invention

The present invention provides an aqueous fabric softener for the treatment of textiles based on water-insoluble nonionic surfactants whose emulsions or dispersions have been stabilized by the addition of protective colloids containing cationic groups.

2. Background of the Invention

The conventional laundry fabric softener, distearyldimethylammonium chloride (DSDMAC), has become subject to environmental discussion over the last few years owing to its aquatic toxicity. In the meantime, it has been replaced on the market by ester- or amide-containing quaternary ammonium bases or imidazolinium salts whose environmental characteristics are given a better rating.

In textile finishing, large amounts of noncationic auxiliaries, such as sulphonated fats, ethoxylates, silicones and waxes, are also successfully used for softening. Unlike household laundry fabric softening, softener emulsions are here applied in a relatively high concentration (10–50 g/l) by various methods, such as spraying, distribution or abstraction methods, depending on which softening effect is desired.

In contrast, a requirement of a good household laundry fabric softener is that it shows quantitative exhaustion onto the textiles to be treated from a highly dilute rinsing liquor emulsion (0.2 to 0.7 g/l). The well known effectiveness of the conventional cationic fabric softeners is based in particular on the distinct chemisorption of the emulsified cationic particles which are absorbed on the fiber by virtue of the ionic interaction with the anionic fiber surface. It is known from the literature that good softening effects can be achieved by mixing nonionic and cationic softeners. Thus, for example, fabric softener emulsions based on a mixture of lanolin or propoxylated lanolin and a conventional quaternary ammonium base which show good softening effects in laundry treatment (EP 0,086,104) have been proposed. A further advantage of these mixed emulsions is that they can be handled as highly concentrated emulsions without thickening, which often creates problems in the case of purely cationic active compound emulsions. The same effect is also achieved by other nonionic additives, such as, for example, alkylene oxide adducts of fatty alcohols, fatty acid amides and fatty acid esters and natural fats (EP 0,056,695; EP 0,159,919). Commercially available fabric softeners nowadays contain about 15% of co-softener, such as, for example, glycerol monostearate or fatty alcohol ethoxylates (Tenside Surf. Det. 27, 34–40 (1990)).

SUMMARY OF THE INVENTION

Accordingly, one object of the present invention is to prepare a novel fabric softener which is free of the conventional quaternary ammonium bases with their known disadvantages.

The present inventors have discovered that this object is achieved by adding a cationic protective colloid to emulsions of nonionic hydrophobic surfactants. This causes surface cationization of the surfactant vesicles present in the emulsion, as a result of which there is substantial absorption onto the textile fiber to be softened.

Thus, the invention provides an aqueous fabric softener for the treatment of textiles, based on water-insoluble nonionic surfactants whose emulsions or dispersions have been stabilized by the addition of protective colloids containing cationic groups.

DETAILED DESCRIPTION OF THE PREFERRED EMBODIMENTS

Suitable nonionic fabric softener active compounds useful in accordance with the present invention include a multiplicity of classes of nonionic surfactants known per se which, in particular, contain two C chains of similar length, the chain length of which can be $C_{10}$–$C_{22}$, as the hydrophobic portion and a nonionic polyether or polyol chain or a sugar or polysaccharide derivative as the hydrophilic portion.

Suitable non-ionic surfactants contain one to four long hydrophobic chains and a glycose or polysaccharide radical, a polyol chain or a polyether chain as the hydrophilic group. Alternatively, nonionic surfactants which contain two long hydrophobic chains and a glycose or polysaccharide radical, a polyol chain or a polyether chain as the hydrophilic group can be used.

Suitable nonionic surfactants are the commercially available Guerbet alcohols which are prepared by alkaline condensation of fatty alcohols. The degree of hydrophilicity can be adjusted by ethylene oxide addition or propylene oxide addition. Preferably alkoxylated branched alcohols of the general formula:

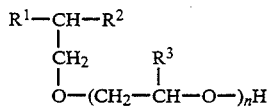

where $R^1$ and $R^2$ are branched or straight-chain $C_{10}$–$C_{22}$-alkyl radicals and can be identical or different, and $R^3$ represents hydrogen or a methyl radical, and n is an integer of from 1 to 30 are used.

Suitable nonionic surfactants alternatively are mono-, di-, tri-fatty acid esters of polyols of the general formula $$HOCH_2—(CHOH)_m,—CH_2OH$$

in which m is a number from 1 to 4, and the acyl radicals are branched or straight-chain $C_{10}$–$C_{22}$-chains and can be identical or different. Preferably, di-fatty acid esters of polyols of the general formula $$HOCH_2—(CHOH)_m,—CH_2OH$$

in which m is a number from 1 to 4, and the acyl radicals are branched or straight-chain $C_{10}$–$C_{22}$-chains and can be identical or different are used. More preferably, di-fatty acid esters or a mixture of mono-, di- and tri-fatty acid esters of glycerol are used.

Alternatively, nonionic surfactants of ecological interest such as the saccharide di-fatty acid esters or the fatty alkyl polyglycoside fatty acid esters or mixtures thereof can also be used. If required, the degree of hydrophilicity can suitably be additionally increased by means of ethylene oxide or propylene oxide addition.

Suitable saccharide di-fatty acid esters include mono-, di-, tri- or tetra-fatty acid ester of a monosaccharide or polysaccharide in which the acyl radicals are branched or linear $C_{10}$–$C_{22}$-chains and can be identical or different. Preferably, a di-fatty acid ester of a monosaccharide or polysaccharide in which the acyl radicals are branched or linear $C_{10}$–$C_{22}$-chains and can be identical or different is used. Suitable fatty alkyl polyglycoside fatty acid esters include mono-, di-, tri-fatty acid esters of fatty alkyl glycosides or fatty alkyl polyglycosides in which the acyl radicals and the fatty alkyl radicals are branched or linear $C_{10}$–$C_{22}$-chains and can be identical or different. Preferably, mono-fatty acid esters of fatty alkyl glycosides or fatty alkyl polyglycosides in which the acyl radicals and the fatty alkyl radicals are branched or linear $C_{10}$–$C_{22}$-chains and can be identical or different are used.

Another suitable class of nonionic surfactants is the fatty acid esters of sorbitol or sorbitan which are preferably present as a mixture of mono-, di- and triesters. In this case too, the degree of hydrophilicity can suitably be varied by alkylene oxide addition. Suitable fatty esters of sorbitol or sorbitan include esters in which the acyl radicals are branched or linear $C_{10}$–$C_{22}$-chains and can be identical or different.

The preferred class of nonionic surfactants used in accordance with the present invention are the diglycerides which are of great interest in terms of ecology and economy because they can be prepared on the basis of cheap natural fats and oils and are readily biodegradable. In this case too, the degree of hydrophilicity can suitably be adjusted by alkoxylation. Diglycerides can be prepared by conventional methods (DE 3,826,179). Suitable diglycerides include esters in which the acyl radicals are branched or linear $C_{10}$–$C_{22}$-chains and can be identical or different.

The addition of cationic protective colloids to laundry fabric softener formulations has not been previously reported. In general, colloidal solutions can be significantly stabilized by hydrophilic protective colloids. The protective colloid surrounds the particle to be protected like a film and forms an envelope of water molecules. Known protective colloids are gelatin, protein hydrolysate, glue, and the like. An example of a suitable cationic protective colloid is commercially available cationic starch (I). It is used, inter alia, in the paper industry. Compared with the electrically neutral protective colloids, it has the advantage that it has substantivity for the negatively charged cellulose fiber of paper.

A further example of a suitable cationic protective colloid in accordance with the present invention is the natural product chitosan (II). Recently, chitosan has gained in economic importance as a renewable resource mainly in Japan and the USA. It is produced by deacetylation of chitin, a waste product from crab fishing. After cellulose, chitin is the world's second most abundant polysaccharide. Chitosan has a molecular weight of 300,000 to 500,000 g/mol and exhibits a higher positive charge density compared with cationic starch. As a primary polyamine, it is effective as a cationic protective colloid only in acidic systems.

In addition to the natural cationic polymers, synthetic polymers can also be used as the cationic protective colloid additive according to the invention. For example, suitable polymers or copolymers of dimethylaminopropylacrylamide or -methacrylamide (III), which are commercially available, can be used.

To prepare the aqueous fabric softener according to the present invention, the aforementioned nonionic water-insoluble surfactants are made into aqueous emulsions in concentrations of 5 to 30 wt. %, based on the total weight of the emulsion, with the aid of small amounts of customary emulsifiers such as fatty alcohol ethoxylates and, if desired, with the addition of acetic acid or lactic acid as solubilizer. The aforementioned cationic protective colloids are then added to this emulsion in amounts of 0.1 to 50 wt. %, preferably 1 to 20 wt. % relative to the nonionic active compound.

Alternatively, the protective colloids can be added to the water prior to the emulsifying process. In the case of chitosan, it is necessary to add an organic acid as solubilizer in order to ensure a pH of 4 to 5 in the rinsing liquor. As a primary polyamine, chitosan is effective as a cationic protective colloid only in an acidic medium.

The fabric softener emulsions thus produced are diluted for the laundry treatment to such an extent that the combination of active compounds is present in the rinsing liquor in a concentration of 0.1 to 1 g/l.

The fabric softening tests which have been carried out show that nonionic surfactants containing at least two long hydrophobic chains in combination with small amounts of cationic protective colloid produce good laundry softening effects. From an ecological point of view, suitable compounds are in particular alkoxylated diglycerides based on natural fats in combination with the natural product chitosan. The system shows good biodegradability and does not contain any quaternary amine functions.

EXAMPLES

Having generally described this invention, a further understanding can be obtained by reference to certain specific examples which are provided herein for purposes of illustration only and are not intended to be limiting unless otherwise specified.

The fabric softening tests which have been carried out are described in more detail in the text which follows and are intended to illustrate the invention in more detail.

Description of the Softening Effect Test Method (Triangle Test)

The softening effect of the claimed laundry fabric softener was carried out in the form of a sensory soft handle test employing 6 testers as follows:

72 terry towels (44 cm·30 cm, about 60 g, from WFK-Testgewebe GmbH), although not all of them were needed, were for reasons of uniform wear subjected as a batch to a machine wash at 95° C. with 100 g of a commercially available heavy-duty detergent (PERSIL, available from Henkel, Germany), rinsing and spin-drying. This was followed by a wash at 95° C. without detergent, including rinsing and a short period of spin-drying, giving clean, moist towels containing water of about 2.5 times their dry weight which were ready for manual fabric softening.

In order to carry out the experimental design analogously to Table A, 9 towels were softened in 9 rinsing liquors containing the standard (=S) and 9 towels were softened in 9 rinsing liquors containing the test substance (=T). To this end, in each case 2 l of tap water and 0.00 or 0.35 g/l of standard (calculated on active compound) or an amount to be freely chosen of the test substance respectively were predispersed in plastic dishes, and the moist towels were left therein for 10 minutes. After 5 minutes, the towels were turned over once. The softened towels were spin-dried individually for 30 seconds each and dried on a clothes horse in still air.

TABLE A

| Experimental design for the sensory soft handle test employing 6 testers. | |
|---|---|
| Tester | Towel combination with code names |
| 1 | SST |
| 2 | SST |
| 3 | SST |
| 4 | STT |
| 5 | STT |
| 6 | STT |

S = comparison substance (standard); T = invention (test substance)

3 towels in coded form according to the experimental design of Table A (so-called triangle test) were handed over to each tester. The task of the tester was to pick out the differently treated towel by sensory assessment.

If this was possible, the tester wrote down whether the differing towel was softer or harder to the touch. If at least 5 or 6 testers picked out the differently treated towel (T in the case of testers 1 to 3, S in the case of testers 4 to 6), there is, according to DIN 10 951, a probability of greater than 95% that there is a significant difference between the test substance and the standard. The result is expressed by means of 3 numbers: The 1st number indicates the number of testers who felt the towels treated with the standard to be softer, respectively, than the ones treated with the test substance to be harder. The 2nd number indicates the number of testers who felt the towels treated with the standard to be harder, respectively, than the ones treated with the test substance to be softer. Finally, the 3rd number indicates the number of testers who were unable to determine the differently treated towel owing to the small sensory differences between the towels treated with the test substance and the towels treated with the standard or did not give the right answer.

The first test substances studied were the ecologically and economically interesting diglycerides based on natural fats. A palm oil propoxylated with 15% by weight of propylene oxide and a skin fat propoxylated with 15% by weight of propylene oxide from Stockhausen were tested. Apart from these, a synthetic $C_{18}$-diglyceride (21% of triglyceride) ethoxylated with 22% by weight of ethylene oxide (EO) was used. A Guerbet alcohol ethoxylated with 12 EO and synthesized by alkaline condensation of a technical grade $C_{16/18}$-fatty alcohol was used as a further example.

The cationic starch selected was a technical grade product having a degree of cationization of 0.02 to 0.03 from Cerestar. The chitosan was used as a cold-soluble hydrochloride (Kyowa Oil and Fat, Japan). A technical grade polyaminoacrylamide acrylic acid copolymer having an acrylic acid content of 10% by weight and a molecular weight of about 1 million from Stockhausen served as the synthetic protective colloid.

The active compounds could be emulsified without difficulty in the presence of the protective colloid with the addition of 1 to 5% by weight of a conventional fatty acid ethoxylate as emulsifier. Acetic acid or lactic acid, which were used in such amounts that a pH of 4.5 to 5.0 was ensured in the dilute rinsing liquor, served as the solubilizer. In this manner, 20% strength readily flowable, stable emulsions could be prepared in the case of chitosan. In the case of the cationic starch and the polyaminoalkylacrylamide, the emulsions were 10% strength.

The comparison substance selected was a commercially available quaternized ester from Stepan (STEPANTEX VR 85).

The test results are summarized in the two tables which follow.

In Table 1, the test results compared with an untreated towel are summarized. In all cases, the addition of cationic protective colloid resulted in a significant soft handle. Compared with a commercially available quaternized ester, the same soft handle is achieved by doubling the rinsing liquor concentration (see Table 2). The cationic protective colloid which showed the best effect was chitosan. An addition of as little as 2.5%, relative to the test substance, is sufficient for achieving a synergistic effect.

TABLE 1

Sensory soft handle test employing 6 testers according to DIN 10951 (so-called triangle test)
Comparison with untreated towels washed with PERSIL

| Rinsing liquor | | Triangle test | | |
|---|---|---|---|---|
| Test substance 0.35 g/l | cat. protective colloid % by weight relative to test substance | untreated softer | Test substance softer | no difference |
| $C_{32/36}$-guerbitol | — | 0 | 1 | 5 |
| +12 EO | +15% of cat. starch | 0 | 5 | |
| Palm oil/15% of PO | — | 0 | 2 | 4 |
| | +13% cat. starch | 0 | 5 | 1 |
| Skin fat/15% of PO | — | 0 | 3 | 3 |
| | +10% cat. starch | 0 | 6 | 0 |
| $C_{18}$-diglyceride/22% of Eo | — | 0 | 1 | 5 |
| | +10% cat. starch | 0 | 5 | 1 |
| — | +100% of chitosan | 0 | 3 | 3 |
| Palm oil/15% of PO | +5% of chitosan | 0 | 5 | 1 |
| Skin fat/15% of PO | +5% of chitosan | 0 | 6 | 0 |
| $C_{18}$-Diglyceride/22% of EO | +5% of chitosan | 0 | 6 | 0 |
| — | +10% of polyaminoacrylamide | 1 | 2 | 3 |
| Palm oil/15% of PO | +5% of polyaminoacrylamide | 0 | 5 | 1 |
| Skin oil/15% of PO | +5% of polyaminoacrylamide | 0 | 4 | 2 |
| $C_{18}$-Diglyceride/22% of EO | +10% of polyaminoacrylamide | 0 | 5 | 1 |

TABLE 2

Sensory soft handle test employing 6 testers according to DIN 10951 (so-called triangle test)
Comparison with commercially available quaternized ester* (0.18 g/l of STEPANTEX VR 85)

| Rinsing liquor | | Triangle test | | |
|---|---|---|---|---|
| Test substance 0.35 g/l | cat. protective colloid by weight relative to test substance | quat. ester softer | test substance softer | no difference |
| Palm oil/15% of PO | — | 4 | 0 | 2 |
| Palm oil/15% of PO | +5% of chitosan | 1 | 0 | 5 |
| Palm oil/15% of PO | 2.5% of chitosan | 1 | 0 | 5 |
| Skin oil/15% of PO | — | 5 | 0 | 1 |
| Skin oil/15% of PO | +5% of chitosan | 1 | 0 | 5 |
| $C_{18}$-Diglyceride/ | — | 4 | 0 | 2 |

TABLE 2-continued

| Sensory soft handle test employing 6 testers according to DIN 10951 (so-called triangle test) Comparison with commercially available quaternized ester* (0.18 g/l of STEPANTEX VR 85) | | | | |
|---|---|---|---|---|
| Rinsing liquor | | | | |
| Test substance 0.35 g/l | cat. protective colloid by weight relative to test substance | Triangle test quat. ester softer | test substance softer | no difference |
| 22% of EO $C_{18}$-Diglyceride/ 22% of EO | +5% of chitosan | 1 | 0 | 5 |

*Quaternized fatty acid ester of triethanolamine

Having now fully described the invention, it will be apparent to one of ordinary skill in the art that many changes and modifications can be made thereto without departing from the spirit or scope of the invention as set forth herein.

Formula I

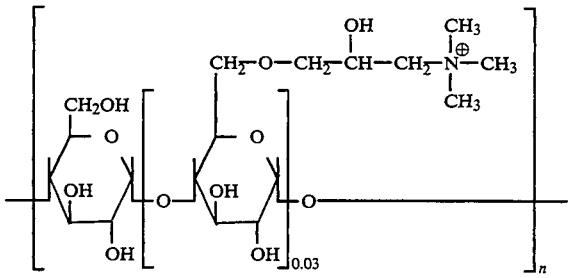

Cationic starch

Formula II

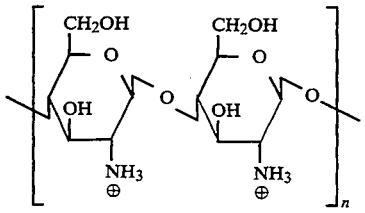

Chitosan

Formula III

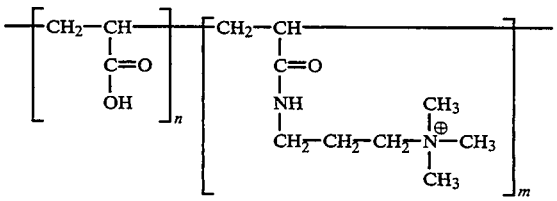

Polyaminoacrylamide

What is claimed as new and desired to be secured by Letters Patent of the United States is:

1. An aqueous fabric softener for the treatment of textiles, comprising an emulsion of a water-insoluble nonionic surfactant selected from the group consisting of an alkoxylated branched alcohol of the general formula:

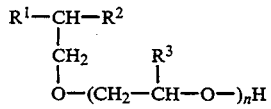

wherein $R^1$ and $R^2$ are branched or straight-chain $C_{10}$–$C_{22}$-alkyl radicals and can be identical or different, and $R^3$ represents hydrogen or a methyl radical, and n is an integer of from 1 to 30, a mono-, di-, tri- or tetra-fatty acid ester of a monosaccharide or polysaccharide in which the fatty acid radicals are branched or linear $C_{10}$–$C_{22}$-chains and can be identical or different, a mono-, di-., or tri-fatty acid ester of a fatty alkyl glycoside or fatty alkyl polyglycoside in which the fatty acid radicals and the fatty alkyl radicals are branched or linear $C_{10}$–$C_{22}$-chains and can be identical or different, and a mono-, di-, or tri-fatty acid ester of a polyol of the general formula:

$$HOCH_2—(CHOH)_m—CH_2OH$$

in which m is a number from 1 to 4, and the fatty acid radicals are branched or straight-chain $C_{10}$–$C_{22}$-chains and can be identical or different, wherein said emulsion further comprises a stabilizing amount of protective colloids containing cationic groups selected from the group consisting of chitosan, a chitosan derivative, a cationic starch and a polymer or copolymer based on aminoalkylacrylamide, wherein said protective colloid is added in amounts of from 0.1 to 50 wt. % relative to the total weight of said nonionic surfactant, and wherein said nonionic surfactant is added in amounts of 5 to 30 wt. % relative to the total weight of said emulsion.

2. The fabric softener according to claim 1, wherein said cationic protective colloid is chitosan or a chitosan derivative.

3. The fabric softener according to claim 2, wherein said fabric softener further comprises an organic acid.

4. The fabric softener according to claim 1, wherein said cationic protective colloid is a cationic starch.

5. The fabric softener according to claim 1, wherein said cationic protective colloid is a polymer or copolymer based on aminoalkylacrylamide.

6. The aqueous fabric softener according to claim 1, wherein said water-insoluble nonionic surfactant contains one to four long hydrophobic chains and a glycose or polysaccharide radical, a polyol chain or a polyether chain as a hydrophilic group.

7. The aqueous fabric softener according to claim 6, wherein said water-insoluble nonionic surfactant contains two long hydrophobic chains and a glycose or polysaccharide radical, a polyol chain or a polyether chain as the hydrophilic group.

8. The fabric softener according to claim 6, wherein said nonionic surfactant is an alkoxylated branched alcohol of the general formula:

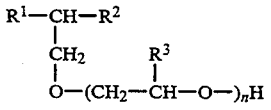

where $R^1$ and $R^2$ are branched or straight-chain $C_{10}$–$C_{22}$-alkyl radicals and can be identical or different, and $R^3$ represents hydrogen or a methyl radical, and n is an integer of from 1 to 30.

9. The fabric softener according to claim 6, wherein said nonionic surfactant is a mono-, di-, tri- or tetra-fatty acid ester of a monosaccharide or polysaccharide in which the fatty acid radicals are branched or linear $C_{10}$–$C_{22}$-chains and can be identical or different.

10. The fabric softener according to claim 6, wherein said nonionic surfactant is a di-fatty acid ester of a monosaccharide or polysaccharide in which the fatty acid radicals are branched or linear $C_{10}$–$C_{22}$-chains and can be identical or different.

11. The fabric softener according to claim 6, wherein said nonionic surfactant is a mono-, di-, or tri-fatty acid ester of a fatty alkyl glycoside or fatty alkyl polyglycoside in which the fatty acid radicals and the fatty alkyl radicals are branched or linear $C_{10}$–$C_{22}$-chains and can be identical or different.

12. The fabric softener according to claim 6, wherein said nonionic surfactant is a mono-fatty acid ester of a fatty alkyl glycoside or fatty alkyl polyglycoside in which the fatty acid radicals and the fatty alkyl radicals are branched or linear $C_{10}$–$C_{22}$-chains and can be identical or different.

13. The fabric softener according to any of claims 9–12, wherein said nonionic surfactants have additionally been alkoxylated with ethylene oxide or propylene oxide.

14. The fabric softener according to claim 6, wherein said nonionic surfactant is a mono-, di-, or tri-fatty acid ester of a polyol of the general formula $$HOCH_2—(CHOH)_m—CH_2OH$$

in which m is a number from 1 to 4, and the fatty acid radicals are branched or straight-chain $C_{10}$–$C_{22}$-chains and can be identical or different.

15. The fabric softener according to claim 6, wherein said nonionic surfactant is a di-fatty acid ester of a polyol of the general formula $$HOCH_2—(CHOH)_m—CH_2OH$$

in which m is a number from 1 to 4, and the fatty acid radicals are branched or straight-chain $C_{10}$–$C_{22}$-chains and can be identical or different.

16. The fabric softener according to claim 14, wherein said nonionic surfactant has additionally been alkoxylated with ethylene oxide or propylene oxide.

17. The fabric softener according to claim 16, wherein said nonionic surfactant is a di-fatty acid ester or a mixture of mono-, di- and tri-fatty acid esters of glycerol.

18. The fabric softener according to any of claims 14 to 17, wherein said nonionic surfactant is an alkoxylated natural fat, oil or mixture thereof with free fatty acids, mono- or diglycerides.

19. A method for the treatment of textiles comprising applying to the textile the fabric softener according to claim 1.

20. The method according to claim 19, wherein the fabric softener is applied to the textile in a rinsing liquid in a concentration of 0.1 to 1.0 g/l.

* * * * *